United States Patent [19]

Young et al.

[11] Patent Number: 4,495,775

[45] Date of Patent: Jan. 29, 1985

[54] SHIPPING CONTAINER FOR STORING MATERIALS AT CRYOGENIC TEMPERATURES

[75] Inventors: John K. Young, Carmel; Alfred Barthel, Indianapolis, both of Ind.

[73] Assignee: Union Carbide Corporation, Danbury, Conn.

[21] Appl. No.: 506,791

[22] Filed: Jun. 22, 1983

[51] Int. Cl.[3] ..... F17C 11/00

[52] U.S. Cl. ..... 62/48; 206/0.7

[58] Field of Search ..... 62/45, 48, 457; 206/0.6, 0.7

[56] References Cited

U.S. PATENT DOCUMENTS

| | | | |
|---|---|---|---|
| 2,030,005 | 2/1936 | Kellogg | 62/385 |
| 2,883,040 | 4/1959 | Pater et al. . | |
| 2,892,563 | 6/1959 | Morrison . | |
| 3,029,967 | 4/1962 | Morrison . | |
| 3,071,045 | 1/1963 | Budd | 62/457 |
| 3,074,586 | 1/1963 | Morrison . | |
| 3,160,307 | 12/1964 | Morrison . | |
| 3,238,002 | 3/1966 | O'Connell | 62/48 |
| 4,129,450 | 12/1978 | Flanigen . | |
| 4,154,363 | 5/1979 | Barthel . | |
| 4,259,846 | 4/1981 | Rudolphi et al. | 62/48 |

OTHER PUBLICATIONS

Johns-Manville—Insulation Product Literature—1-.—Scored Block Insulation, 2.—Pipe & Block Insulation.

*Primary Examiner*—Ronald C. Capossela
*Attorney, Agent, or Firm*—Eugene Lieberstein

[57] ABSTRACT

A container for shipping transportable materials at cryogenic temperatures including a vessel which opens to the atmosphere and contains a micro-fibrous structure for holding a liquefied gas such as liquid nitrogen in adsorption and capillary suspension. The micro-fibrous structure comprises a core permeable to liquid and gaseous nitrogen and an adsorption matrix composed of randomly oriented inorganic fibers surrounding the core as a homogeneous body in stable confinement.

14 Claims, 4 Drawing Figures

SHIPPING CONTAINER FOR STORING MATERIALS AT CRYOGENIC TEMPERATURES

This invention relates to containers for storing materials at cryogenic temperatures and more particularly to an open to atmosphere shipping container adapted to hold a supply of liquid nitrogen for refrigerating a stored biological product during transportation from one location to another over a relatively long time period.

BACKGROUND OF THE INVENTION

The shipment of heat-sensitive bio-systems, as for instance semen, vaccines, cultures of bacteria and viruses at optimal temperature levels between about 78 K, and 100 K. poses a series of difficulties. The vials or "straws", in which the biologicals are hermetically sealed, must be kept continuously at near liquid nitrogen temperature to preserve the viability of the biological product. But since the boiling point of liquid nitrogen at ambient pressure is 77.4 K. (−320.4° F.) the cryogen holding vessel (refrigerator) must remain open to the atmosphere to vent the boiled-off gas and thus avoid a dangerous pressure build-up inside. For this reason open-to-atmosphere liquid nitrogen vessels are used for refrigeration. It is obvious that such vessels must be kept upright at all times to prevent spillage of the cryogen. This condition is difficult to control during a long shipment unless an attendant accompanies the vessel on the trip which is rarely a feasible option.

To overcome the difficulties associated with the shipment of biologicals at cryogenic temperature a shipping container was developed in which the liquid nitrogen is retained in a solid porous mass by adsorption, capillarity and absorption. Based upon this development a patent issued to R. F. O'Connell et al. in 1966 as U.S. Pat. No. 3,238,002. The shipping container described in this patent is of a double-walled construction to provide a vacuum space around the inner vessel which holds the liquid nitrogen. The vacuum space is filled with a multilayer insulation to reduce heat transfer by radiation. An adsorbent and a getter are part of the system to maintain vacuum integrity. The inner vessel is filled with the solid porous mass which, when saturated with liquid nitrogen, will hold the cryogen by adsorption, and capillarity as well as by absorption, similar to a sponge "holding" water. In the center of the porous filler core one or more voids are provided to hold the vials containing the biologicals.

The solid components of the porous mass described in U.S. Pat. No. 3,238,002 are silica (sand), quick-lime, and a small amount of inert heat resistant mineral fibers such as asbestos. The porous mass is formed starting with an aqueous slurry of the filler components which is poured into a mold and then baked in an autoclave under precisely controlled equilibrium conditions of pressure and temperature.

The components undergo a chemical reaction forming a porous mass of calcium silicates, reinforced by inert fibers. The evaporated water leaves inside the dried out solid structure microscopic voids, of complex geometry, sometimes referred to as "pores", which comprise on the average 89.5% of the apparent solid volume. Since the resulting mass is incompressible the mold must either provide the mass with a shape conforming to the inner vessel of the storage container or it must be machined to size. The porous mass is filled with liquid nitrogen by submerging it in a liquid nitrogen bath until it is saturated. The filling operation for a conventional two liter container housing a sand-lime porous mass matrix takes about twenty-four hours.

The baked sand-lime porous mass is intrinsically hydrophilic. Because of this property moisture must be periodically driven out of the porous mass matrix to prevent the accumulation of trapped water. If this is not done, the trapped water will turn into ice crystals every time it is exposed to liquid nitrogen and eventually will crack the brittle microstructure of the filler. This may be prevented by periodically heating the porous structure to above 100° C. after several fill and warm up cycles.

Although the ingredients used in manufacturing the sand-lime porous mass are relatively inexpensive (deionized water, sand, quick-lime and inert fibers, as for example asbestos) the finishing operations in handling a solid porous mass are very expensive due to the high labor costs involved and the elaborate safety precautions required. It is not economically feasible to cast the porous filler in a cryogenic holding vessel. Elaborate safety precautions are indispensable when handling substances like asbestos fibers and noxious dust. In addition, the thermal energy cost is very high for the manufacturing process of the sand-lime filler mass.

Alternative systems for retaining liquid nitrogen in a container through a combination of adsorption, absorption and capillarity have in the past being investigated by those skilled in the art. The use of high porosity blocks, artificial stones, bricks and light papers made from cellulose fibers such as towels and bathroom tissues have been studied and, in general have been dismissed as inferior compared to the use of the sand-lime porous mass matrix due primarily to their low porosity. The average porosity of the sand-lime porous matrix is 89.5% whereas the porosity of a matrix fabricated from any of the aforementioned materials is below 60%. More recently block insulation material composed of hydrous calcium silicate has been used as the adsorption matrix. Such material is closer in porosity to the sand-lime porous mass composition but also has most of the shortcomings of the sand-lime porous mass composition. The porosity of the filler matrix determines for a given size shipping container its liquid nitrogen capacity. The porosity and rate of evaporation are the most important characteristics of a liquid nitrogen storage container for transporting a product at cryogenic temperatures. A storage container using a sand-lime porous mass matrix has an average 5 day holding time based on an evaporation rate of 0.33 liters per day and a liquid capacity of 1.6 liters.

Accordingly, the art has long sought a less expensive and much more efficient liquid nitrogen adsorption system as an alternative to the storage systems in present use.

OBJECTS OF THE INVENTION

It is therefore, the principle object of the present invention to provide a low cost refrigerated container for transporting bio-systems at cryogenic temperatures.

It is another object of the present invention to provide a refrigerated container for shipping a bio-system over a long holding period during which time the bio-system is sustained in suspended animation at cryogenic temperatures.

It is yet another object of the present invention to provide a low cost refrigerated container having a liquid nitrogen adsorption matrix which has a high average holding capacity and is intrinsically hydro-neutral.

A still further object of the present invention is to provide a refrigerated container having a liquid adsorption matrix which has a higher adsorptivity than state of the art liquid nitrogen adsorption matrices and which will fill to capacity in a substantially reduced time period.

BRIEF DESCRIPTION OF THE DRAWINGS

Further objects and advantages of the present invention will become apparent from the following detailed description of the invention when read in conjunction with the accompanying drawings of which.

SUMMARY OF THE INVENTION

The container of the present invention includes a vessle which opens to the atmosphere and contains a micro-fibrous structure for holding a liquified gas such as liquid nitrogen in adsorption and capillary suspension. The micro-fibrous structure broadly comprises a core permeable to liquid and gaseous nitrogen having a cavity extending therethrough which is adapted for the removable placement of a product to be transported at cryogenic temperatures and a liquid nitrogen adsorption matrix surrounding the core with the matrix being composed of a homogeneous mass of randomly oriented short particles of inorganic fibers, e.g. glass, quartz, or ceramic of extremely small diameters. The matrix should fill substantially all of the space of the inner vessel unoccupied by the core and lie in a contiguous relationship with the core and the inner vessel. The core is preferably tubular with the hollow center used as the storage cavity for receiving the transportable product. The shipping container is preferably of a double walled construction to provide a vacuum space between the inner and outer walls with the inner wall defining the liquid nitrogen holding vessel. The vacuum space is filled with insulation preferably multilayer insulation consisting of e.g. low emissivity radiation barriers interleaved with low heat conducting spacers.

DESCRIPTION OF THE PREFERRED EMBODIMENT

Figure 1:
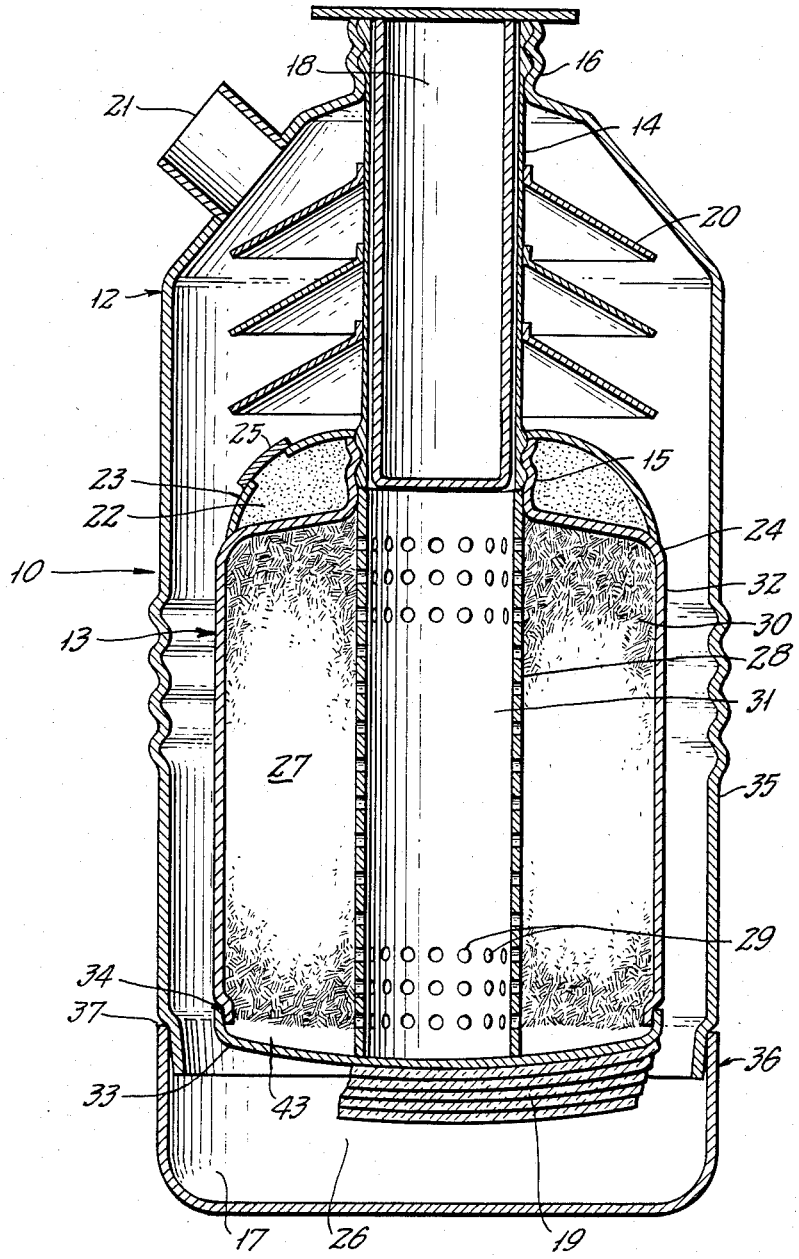
FIG. 1 is a front elevational view, in section, of the shipping container of the present invention.

The invention is illustrated in the preferred embodiment of FIG. 1 which shows a shipping container 10 having a self supporting outer shell 12 surrounding an inner vessel 13. The inner vessel 13 is suspended from the outer shell 12 by a neck tube 14. The neck tube 14 connects the open neck 15 of the inner vessel 13 to the open neck 16 of the outer shell 12 and defines an evacuable space 17 separating the outer shell 12 and the inner vessel 13. A neck tube core 18 is removably inserted into the neck tube 14 to reduce heat radiation losses through the neck tube 14 as well as to prevent foreign matter from entering into the inner vessel 13 and to preclude moisture vapors from building up highly objectionable frost and ice barriers inside the neck tube 14. The neck tube core 18 should fit loosely within the neck tube 14 to provide sufficient clearance space between the neck tube 14 and the neck tube core 18 for assuring open communication between the atmosphere and the inner vessel 13.

The evacuable space 17 is filled with insulation material 19 preferably composed of low emissivity radiation barriers, like aluminum foil, interleaved with low heat conducting spacers or metal coated nonmetallic flexible plastic sheets which can be used without spacers. Typical multilayer insulation systems are taught in U.S. Pat. Nos.: 3,009,600, 3,018,016, 3,265,236, and 4,055,268, the disclosures of which are all herein incorporated by reference. A plurality of frustoconical metal cones 20 may be placed around the neck tube 14 in a spaced apart relationship during the wrapping of the insulation in order to improve the overall heat exchange performance of the storage container 10 following the teachings of U.S. Pat. No. 3,341,052 the disclosure of which is herein incorporated by reference.

To achieve the required initial vacuum condition in the evacuable space 17, the air in the evacuable space 17 is pumped out through a conventional evacuation spud 21 using a conventional pumping system now shown. After the evacuation has been completed the spud 21 is hermetically sealed under vacuum in a manner well known in the art using, for example, a sealing plug and cap (not shown).

An adsorbent 22 is located in the vacuum space 17 to maintain a low absolute pressure of typically less then $1\times10^{-4}$ torr. The adsorbent 22 may be placed in a retainer 23 formed between the shoulder 24 and the neck 15 of the inner vessel 13. The retainer 23 has a sealable opening 25 through which the adsorbent 22 is inserted. The adsorbent 22 is typically an activated charcoal or a zeolite such as Linde 5A which is available from the Union Carbide Corporation. A hydrogen getter 26 such as palladium oxide (PdO) or silver zeolite may also be included in the vacuum space 17 for removing residual hydrogen molecules. To those skilled in the art it is apparent that other locations, as well as methods of placement of the adsorbent and the hydrogen getter, are feasible.

Figure 2:
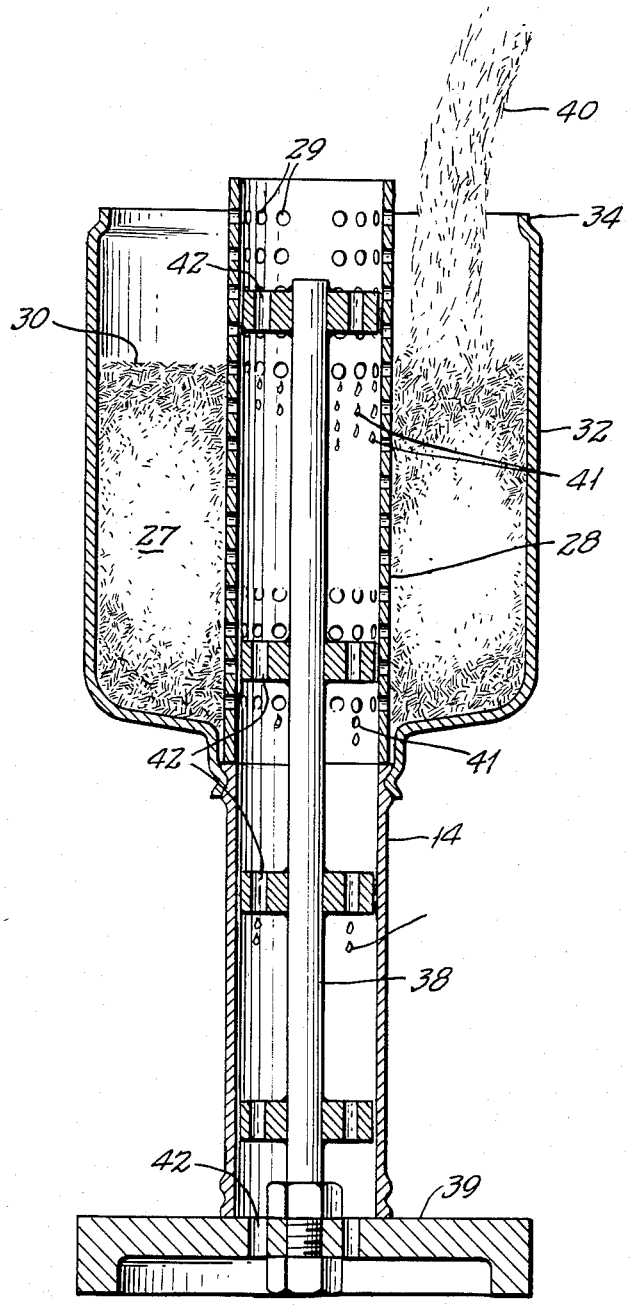
FIG. 2 shows a preferred insertion technique for forming the micro-fibrous adsorption matrix within the inner vessel of the cryogenic shipping container of FIG. 1 before the bottom end of the inner vessel is attached.
Figure 3:
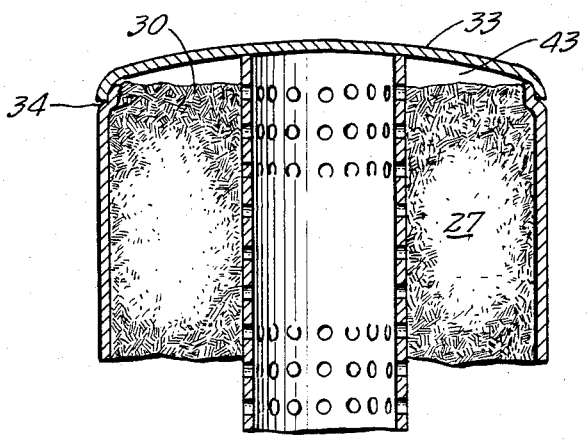
FIG. 3 is a partial view of FIG. 2 showing the inner vessel after the fibrous adsorption matrix has been formed and the bottom end attached.

The inner vessel 13 contains a micro-fibrous structure 27 for holding liquid nitrogen by adsorption and capillary suspension. The micro-fibrous structure 27 comprises a permeable cylindrical core 28 and a liquid nitrogen adsorption matrix 30 composed of a homogenous mass of randomly oriented short particles of inorganic fibers e.g. glass quartz or ceramic of very small diameter. The micro-fibrous structure 27 is shown in longitudinal cross-section in FIG. 2 at the manufacturing stage. The upper cylindrical portion 32 of the inner vessel 13, hermetically sealed between and permanently attached to the neck tube 14, as well as the permeable cylindrical core 28 are placed in a loosely fitting relationship over a columnar extension 38 of a support device 39. The cylindrical portion 32 with the attached necktube 14 are placed for this operation upside-down, that is, the unattached necktube end is facing downwards. The open space between the tubular core 28 and the inner surface of the cylindrical portion 32 is filled with an aqueous micro-fibrous slurry 40 of inorganic fibers preferably glass poured from a mixing vat (not shown) at such a rate that the water 41 from the in-pouring slurry 40 is free to flow through the openings 29 in the core 28 as well as down through passages 42 in the columnar support 38, leaving the moist semi-solid micro-fibrous glass residue to form the homogenous body of the adsorption matrix 30. The slurry influx is stopped when the level of the body 30 reaches the rim 34. The matrix 30, consisting of a quasi-infinite number of randomly oriented inorganic micro-fiber particles, typically about 3 mm to 10 mm in length, is then, hermetically sealed inside the inner vessel 13 by welding the bottom 33 around the circumference of 34, as shown in the partial cross-sectional view of FIG. 3. A curved bottom plate 33 is used to provide an ullage 43 between the matrix 30 and the bottom end of the inner vessel 13 to enable the liquid nitrogen to readily permeate the matrix 30 axially as well as radially. The residual moisture in the matrix 30 can be removed by the application of moderate heat (raising the temperature to about 70° C.) and by simultaneous application of a coarse vacuum of about 20 to 150 torr.

Figure 4:
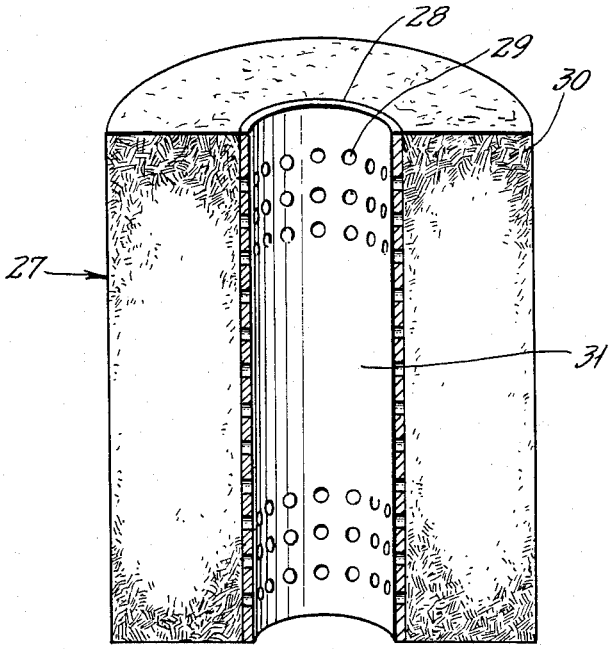
FIG. 4 is a perspective view of the micro-fibrous adsorption structure of FIG. 1 formed as a self-supported structure by an alternate manufacturing process.

However, to those skilled in the art it is apparent that other processes can be used for the manufacture of the matrix 30. One of them, very similar to the one described above, would consist for example, of a long cylindrical mold made up of two longitudinal hemi-cylindrical halves that could be separated from each other for easy removal of the molded product. The inside diameter of the mold wuld be the same as the inside diameter 11 of the inner vessel 13 in FIG. 1. The permeable core would be an appropriate tubing, matching in length the hemi-cylindrical mold. The void between the inside of the mold and the outside of the permeable core would be filled with an aqueous micro-fibrous slurry and treated afterwards in a similar fashion as the individual matrix shown in FIG. 2. The end product of such an operation would be a long cylindrical semi-finished micro-fibrous adsorptive body 30 surrounding a permeable core 28 which would then be cut into pieces of appropriate length to form a structure 27 as shown in FIG. 4 corresponding exactly to the structure 27 of FIG. 1. Since the microfibrous structure 27 is the same identical reference characters have been used in describing the alternate methods of manufacture. The pre-fabricated and pre-cut structure 27 of FIG. 4 would then be inserted into the upper cylindrical section 32 of the inner vessel 13 of FIG. 1. The open bottom would then be closed using a curved bottom plate 33 which may be welded around the periphery 34 as explained earlier in connection with FIG. 3 leaving an ullage 43 between the bottom plate 33 and the structure 27. This ullage 39 may readily be avoided leaving no open space 43 if so desired.

Although one does not ordinarily associate glass with characteristics such as sponginess and porosity, it has been discovered in accordance with the present invention that reasonably compacted glass fibers possess high capacity for holding liquid nitrogen by adsorption and capillary suspension provided the glass fibers in forming the web are of very small diameter. The liquid nitrogen is held in the micro-fibrous matrix 30 by molecular adsorption to the enormous aggregate area of the microfibers, as well as by capillary suspension made possible by the microscopic intra-fibrous voids between individual fibers. It is therefore of importance that the diameters of the glass fibers be as small as possible with the preferred range from 0.03 to 8 microns. The body of micro-fiber glass particles should preferably be formed without using any rigidizing binders or cements. The structural stability of the felt-like body is effected primarily by intra-fibrous friction. Substantially binderless inorganic micro fibers in diameters ranging from 0.3 to 8 micron are commercially available from e.g., the Manville Corporation and Subsidiaries, Denver, Colo. and Owens-Corning, Toledo, Ohio. The glass fibers used in this invention are composed of borosilicate glass with the glass fibers ranging from 0.5 to 0.75 microns in diameter.

The core 28 is preferably of tubular geometry having a central void 31 into which the biological product is to be placed during shipment. It should be understood that the invention is not limited to a single void 31. Multiple voids 31 may be readily formed using multiple cores 28 and arranged in any desired pattern or geometry. The core 28 can be of any material composition, e.g., metal or plastic that will remain structurally stable and retain its form after being repeatedly subjected to cold shocks at liquid nitrogen temperatures. To maintain the lowest possible temperature within the cavity 31 the core 28 must be permeable to the nitrogen gas that boils off from the liquid nitrogen stored in the glass fiber matrix 30. The permeability of the core can be provided by forming the core 28 from a perforated sheet rolled into a tube or using a porous sintered tube without apparent holes. Where perforations are used, the holes 29 in the wall of the core 28 must be small enough to prevent any loose fiber particles from passing across the core wall 28 into the storage cavity 31 containing the biological product.

The storage container 10 of FIG. 1 is preferably assembled starting with the inner vessel assembly 13 of a two piece construction, having an upper cylindrical section 32 with an open end bottom 34, a lower section 33, and then neck tube 14 permanently attached by way of the open neck 15 to cylindrical section 32, employing any acceptable joining method.

The adsorption/storage system 27, comprising the homogenous micro-fibrous matrix 30 and the permeable core 28, in coaxial alignment with the neck tube 14, make up the inner container assembly 13.

The outer shell 12 is also of a two piece construction with an upper cylindrical section 35 and a lower bottom section 36. The inner vessel 13 is inserted into the upper section 35 before the two sections are joined to each other. Where a wrapped composite insulation system is used, the inner vessel is first wrapped with the layers of insulation preferably using the heat exchange cones 20 before the inner vessel 13 is inserted into the upper section 35. The adsorbent 22 is placed inside the adsorbent retainer 23 before the insulation is applied. The upper section 35 may have crimped end 37 to facilitate attachment of the lower section 36. Before the two sections 35 and 36 are welded together to from a unitary structure, the getter composition 26 is placed inside the vacuum space 17. Instead of circumferential crimping as shown in 34 and 37 of FIG. 1 other means of alignment of mating cylindrical components can be used, e.g. butt welding with a back-up ring or tack welding in a jig.

The liquid capacity of the micro-fibrous matrix with randomly oriented fiber particles is determined by the apparent volume of the matrix and its "porosity". The design volume being 2,400 $cm^3$ and the "porosity" of the microfibrous adsorption medium having a mean value of 92%, the mean liquid capacity of such a cryogenic storage container is found to be 2,400 $cm^3 \times 0.92 = 2{,}208\ cm^3$ or about 2.2 liters.

This then is the design figure for the amount of liquid nitrogen to be held within the micro-fibrous matrix by adsorption and capillarity without drainage or spillage.

In service, the liquid nitrogen, held in the matrix, keeps evaporating due to the unavoidable heat inflow from ambient resulting from the temperature gradient between ambient and liquid nitrogen. Eventually all the cryogen is bound to boil off completely, leaving the storage compartment for the temperature sensitive product without refrigeration. Considering this circumstance, which in essence is a race between the hold time of the storage container and the shipping time of the product, the rate of evaporation is the most important characteristic of a shipper-refrigerator.

The evaporation rates of containers of this invention have a mean value of 0.084 liter/day. This low evaporation rate makes it possible to achieve a mean holding time of:

$$\frac{2.2 \text{ liters}}{0.084 \text{ liter/day}} = 26 \text{ days}$$

compared to 5 days for the state-of-the-art shippers. In other words, a shipper/refrigerator of this invention will provide the required near liquid nitrogen temperature inside its storage compartment to maintain bio-systems in the state of suspended animation throughout a maximum of 26 days of transportation, regardless whether the shipper is standing upright, laying on the side, or even upside-down.

The invention as described in accordance with the preferred embodiment should not be construed as limited to a specific configuration for the core and adsorption matrix in defining the micro-fibrous structure. For example, the core may have a plurality of voids defined, for example, within a tubular framework with the voids separated by partitions extending from a solid control post to the outer tubular wall of the core. In such case only the outer tubular wall of the core must be permeable to gaseous nitrogen.

We claim:

1. A shipping container for transporting materials at cryogenic temperatures having a micro-fibrous structure with randomly oriented fiber particles adapted for holding a liquefied gas such as liquid nitrogen in adsorption and capillary suspension within the interior of the container, said micro-fibrous structure comprising a core permeable to gaseous and/or to liquid nitrogen, with said core being disposed in said container and having at least one void adapted for the removable placement of the transportable materials; and a liquefied gas adsorption matrix composed of a mass of very small diameter substantially non-porous inorganic fibers in a range from 0.03 to 8 microns in diameter with the fibrous particles surrounding said core as a homogeneous body having an outside diameter conforming to the diameter of the shipping container.

2. A shipping container as claimed in claim 1 further comprising an inner vessel containing said micro-fibrous structure, an outer shell surrounding said inner vessel and spaced apart therefrom to define an evacuable space therebetween with said inner vessel being open to the atmosphere and insulation material occupying said evacuable space.

3. A shipping container as claimed in claim 2 wherein said inner vessel and outer shell each have an open neck and further comprising a neck tube connecting the open neck of said outer shell to the open neck of said inner vessel.

4. A shipping container as claimed in claim 3 wherein said insulation material is composite multilayered insulation composed of a radiant heat reflecting component and a low heat conducting component disposed in relation to the radiant heat reflecting component so as to minimize the transfer of heat across evacuable space.

5. A shipping container as claimed in claims 1, 3, or 4 wherein said micro-fibrous structure surrounding said core is in the form of a felt-like homogeneous body composed of an extremely large number of randomly oriented inorganic microfiber particles in relatively close engagement with one another.

6. A shipping container as defined in claim 5 wherein said inorganic fibers are composed of borosilicate glass.

7. A storage container as defined in claim 5 wherein said inorganic fibers are composed of quartz.

8. A shipping container as claimed in claim 5 wherein said insulation material consists essentially of finely divided particles of agglomerate sizes, less than about 420 microns, of low heat conducting substances such as perlite, alumina, and magnesia, with or without admixture of finely divided radiant heat reflecting bodies having reflecting metallic surfaces of sizes less than about 500 microns.

9. A shipping container as claimed in claim 5 wherein said core is of a hollow tubular construction with said void defined by the hollow space in said core.

10. A shipping container as defined in claim 9 wherein said core has a multiple number of small perforated openings of a suitable geometric configuration and size.

11. A shipping container as defined in claim 9 wherein said core is of an intrinsically permeable structure having inherent micro-passages throughout its body.

12. A container for shipping transportable materials at cryogenic temperatures comprising:

an inner vessel having an open end; an outer shell having an open end; access means connecting said open end of said outer shell to said open end of said inner vessel such that said inner vessel is suspended from said outer shell in a spaced apart relationship for defining an evacuable space therebetween; insulation means disposed within said evacuable space; and a microfibrous structure located within said inner vessel for holding liquid nitrogen by adsorption and capillary suspension, said micro-fibrous structure comprising a gas permeable core having a void disposed in said inner vessel in alignment with said access means, with said access means providing ingress and egress to said void for removably inserting said transportable materials and a liquid nitrogen adsorption matrix composed of randomly oriented very small diameter substantially non-porous inorganic fibers in a range from 0.03 to 8 microns in diameter with the fibrous particles surrounding said core in form of a stable homogeneous body with an outside diameter conforming to the inside diameter of said inner vessel.

13. A structure for holding a liquified gas such as liquid nitrogen in adsorption and capillary suspension comprising a core permeable to liquid and gaseous nitrogen having a cavity extending therethrough and a liquified gas adsorption matrix composed of a mass of an extremely large number of randomly oriented microfiber particles having a diameter in a range of between 0.03 to 8 microns in relatively close engagement with one another surrounding said core as a homogeneous body.

14. A structure as defined in claim 13 wherein said microfiber particles are selected from the class consisting of glass, quartz and ceramic.

* * * * *